US008498740B2

(12) United States Patent
Truttmann

(10) Patent No.: US 8,498,740 B2
(45) Date of Patent: Jul. 30, 2013

(54) ARRANGEMENT FOR THE MAINTENANCE OF A SLIDING CLOSURE MOUNTED ON THE SPOUT OF A CONTAINER FOR MOLTEN METAL

(75) Inventor: Urs Truttmann, Cham (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 1055 days.

(21) Appl. No.: 12/439,003

(22) PCT Filed: Aug. 31, 2007

(86) PCT No.: PCT/EP2007/007630
§ 371 (c)(1),
(2), (4) Date: Jun. 1, 2009

(87) PCT Pub. No.: WO2008/025562
PCT Pub. Date: Mar. 6, 2008

(65) Prior Publication Data

US 2010/0017027 A1 Jan. 21, 2010

(30) Foreign Application Priority Data

Sep. 1, 2006 (EP) ..... 06405375

(51) Int. Cl.
*G06F 19/00* (2011.01)

(52) U.S. Cl.
USPC ..... 700/245; 222/591; 222/597

(58) Field of Classification Search
USPC . 164/5, 46, 242, 244; 222/597, 591; 700/245, 700/274
See application file for complete search history.

(56) References Cited

U.S. PATENT DOCUMENTS 4,359,815 A * 11/1982 Toyoda ..... 483/14
4,385,715 A 5/1983 Meier et al.
4,685,850 A * 8/1987 Ohta et al. ..... 198/465.1
4,697,979 A * 10/1987 Nakashima et al. ..... 700/247

(Continued)

FOREIGN PATENT DOCUMENTS

EP 2056983 B1 2/2011
JP 7060434 A 3/1995

(Continued)

OTHER PUBLICATIONS

English-language Abstract of JP-A-8109853, JP8019853A.

(Continued)

*Primary Examiner* — Khoi Tran
*Assistant Examiner* — Stephen Holwerda
(74) *Attorney, Agent, or Firm* — Brian Roffe

(57) ABSTRACT

Arrangement for the maintenance of a sliding closure mounted on the spout of a container for molten metal. The arrangement includes at least one tool magazine, at least one replacement part magazine and a system for opening and closing the sliding closure. The robot includes an automatic grip changing system and is operationally connected to a control unit to enable it to automatically detect the exact position of the container or of the sliding closure. Thereafter, the robot can control opening and closing of the sliding closure and, depending on the condition of the individual components to be replaced, it can grip tools or replacement parts from the magazines surrounding the robot and can perform cleaning operations, dismantle components and replace or reinstall the same. In this way, personnel can be saved and the occupational safety is thus increased.

19 Claims, 3 Drawing Sheets

U.S. PATENT DOCUMENTS

| | | | | |
|---|---|---|---|---|
| 4,848,604 | A | 7/1989 | Fricker | |
| 5,836,485 | A * | 11/1998 | Plattner et al. | 222/600 |
| 5,917,115 | A * | 6/1999 | Wondris | 75/508 |
| 6,045,015 | A | 4/2000 | Waltenspuhl et al. | |
| 2002/0153117 | A1 * | 10/2002 | Allor et al. | 164/46 |
| 2003/0183361 | A1 * | 10/2003 | Laurino | 164/323 |
| 2004/0026061 | A1 * | 2/2004 | Hamilton et al. | 164/47 |
| 2004/0089231 | A1 * | 5/2004 | Gilmore et al. | 118/425 |
| 2004/0108092 | A1 * | 6/2004 | Howard et al. | 164/76.1 |
| 2005/0102061 | A1 * | 5/2005 | Lent | 700/245 |

FOREIGN PATENT DOCUMENTS

| | | | |
|---|---|---|---|
| JP | 8019853 | A | 1/1996 |
| JP | 10263796 | A | 10/1998 |
| JP | 2001150276 | A | 6/2001 |

OTHER PUBLICATIONS

English-language Abstract of JP-A-2001150276.
English-language Abstract of JP-A-7060434.
English-language Abstract of JP-A-10263796.

* cited by examiner

ARRANGEMENT FOR THE MAINTENANCE OF A SLIDING CLOSURE MOUNTED ON THE SPOUT OF A CONTAINER FOR MOLTEN METAL

FIELD OF THE INVENTION

The invention relates to an arrangement for the maintenance of a sliding closure mounted on the spout of a container for molten metal with at least one tool magazine, at least one replacement part magazine, and a robot provided with an automatic grip changing system that is at least operationally connected to a control unit.

BACKGROUND OF THE INVENTION

Sliding closures on the spout of containers for molten metal are known in many different embodiments, these basically possibly being sliding closures with a linearly adjustable slider unit (see e.g. EP-A-0 875 320) or rotary sliding closures (see e.g. CH-A-649 149). As is well known, the fire-resistant components of these sliding closures, in particular the closure plates, but also their spout covers and the covers on the container outlet, are subjected to heavy wear and tear and must from time to time be inspected and if need be be changed. The emptied container, e.g. a so-called pan, is brought together with the sliding closure to a maintenance point, a so-called pan position, where the horizontally positioned pan is cleaned, the sliding closure is opened, and the individual components which if need be are to be replaced, are dismantled using appropriate tools, cleaning operations are performed and then the components or the replacement parts for the latter are assembled again. In the specialist jargon this maintenance is also called preparation. These maintenance and preparation operations must be carried out manually. The way in which the sliding closure is opened and the means for opening and closing the sliding closure depend upon the design of the respective closure.

A sliding closure provided with a linearly adjustable slider unit is—as described for example in EP-A-0 875 320—actuated by means of a piston/cylinder unit that can be mounted on the sliding closure in order to open or close the pouring channel. Unlike the sliding closure, the piston/cylinder unit is not always attached to the pan, but it remains—once again removed from the sliding closure—on the pouring unit or in the pan position where the opening and closure of the pouring channel is to take place. When mounting on the sliding closure, the cylinder is inserted into a retainer on the slider housing and held securely in position in the latter while the drive rod is coupled to the slider unit. The slider unit's stroke for opening and closing the pouring channel is restricted by a stroke limitation bolt. If the closure plates are to be changed, the stroke limitation bolt is removed and the slider unit pushed out over the one limit position after which it is released from the slider housing and pivoted out in relation to the latter, and the closure plates are made accessible.

With a changing device according to publication JP-A-10263796 for changing a fire-resistant material in a sliding closure mounted on a steel pan, a stage moveable on rails and a robot disposed on the latter are provided which can be equipped with various tools. Moreover, slider plates and cover magazines are provided in addition to the robot on this stage.

The object which forms the basis of the present invention is to provide an arrangement of the type specified at the start with which the maintenance and preparation operations can be substantially facilitated.

This object is achieved according to the invention by an arrangement wherein a robot is able to automatically detect an exact position of a container or of a sliding closure, means for opening and closing the sliding closure are provided which comprise a piston/cylinder unit which can be brought by the robot from a repository to the sliding closure and that are mountable on the sliding closure and connectable to a pressure source, and wherein the robot can, depending on the condition of individual components that might need to be replaced, grip tools or replacement parts from the magazines surrounding it and perform cleaning operations, dismantle components and replace or reinstall the same.

Further preferred embodiments of the arrangement according to the invention form the subject matter of the dependent claims.

Advantages are obtained with this arrangement according to the invention—on the one hand that fewer staff members are needed to carry out the maintenance and preparation operations, which reduces costs, it also being guaranteed that the operations proceed without any error. Moreover, there is a higher level of work safety then with the conventional preparations because the operators no longer need to carry out work directly in front of the hot pan.

BRIEF DESCRIPTION OF THE DRAWINGS

In the following the invention is described in greater detail by means of the drawings. These show as follows.

DETAILED DESCRIPTION OF THE INVENTION

Figure 2:
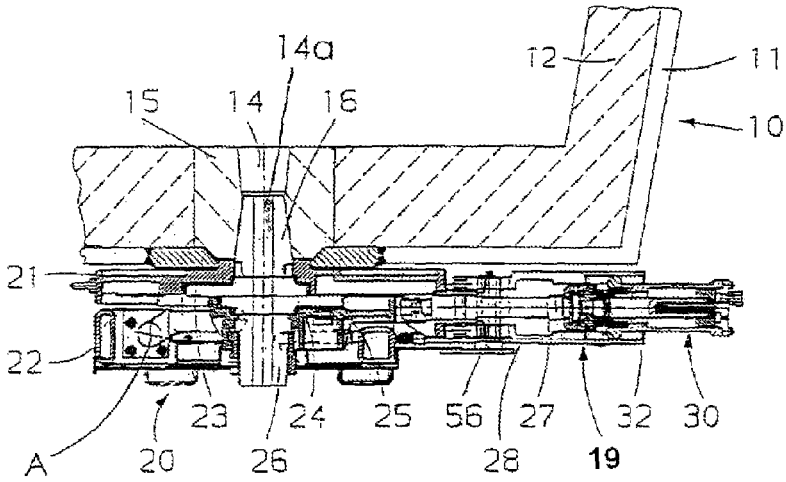
FIG. 2 a longitudinal view of an exemplary embodiment of a sliding closure on the spout of a partially illustrated container for molten metal.

FIG. 2 shows a portion of a container 10 for molten metal, a so-called pan, on the spout of which a sliding closure 20 is mounted. The container 10 has an outer steel jacket 11, a fire-resistant coating 12 embedded into the latter, and an outlet 14 which is formed from a fire-resistant perforated brick 15 and a fire-resistant cover 16 inserted into the latter.

The sliding closure 20 can for example be the sliding closure known from EP-A-0 875 320 and also described in detail in EP-B-0 277 146. The latter comprises an upper housing part 21 with a fire-resistant closure plate 23 inserted therein and a housing frame 22 with a slider unit 25 releaseably braced therein in which a fire-resistant slider plate 24 is inserted to which a fire-resistant spout cover 28 is attached. By moving the slider unit 25 the outlet 14 and a pouring channel 14*a* can be brought from the opening position illustrated in FIG. 2 into a throttle or closed position (and vice versa).

The linear adjustment of the slider unit 25 is implemented by means of a piston/cylinder unit 30 which is removeably disposed in a retainer 28 flanged onto the upper housing part 21, i.e. contrary to the sliding closure 20 the piston/cylinder unit 30 does not remain constantly on the container 10, but is left on the pouring stage or also on the maintenance point, the so-called pan position. The cylinder part of the piston/cylinder unit 30 is pushed into the retainer 28, a drive rod 32 of the same is then coupled to a driving rod 27 of the slider unit 25 by means of a coupling 19.

The stroke of the slider unit 25 for the adjustment from the opening position shown into the closure position is restricted by a stroke limitation bolt 56 which is inserted removeably into the retainer 28 and passes through a longitudinal opening in the driving rod 27. The stroke limitation bolt 56 can be disengaged from the longitudinal opening if, for example, a closure plate change is to take place. The slider unit 25 can then be moved beyond the closure position over corresponding guide tracks and be released from the frame 22 and from the upper housing part 21 and be pivoted out in relation to the latter.

With the embodiment shown in FIG. 2 the slider unit 25 is pivoted out downwardly about a horizontal axis A, but pivoting out to the side could also be provided. In the pan position already mentioned, where maintenance of the container 10 and of the sliding closure 20 takes place, the container or the pan 10 are brought into a horizontal position and the direction of movement of the slider unit 25 extends vertically so that in the embodiment according to FIG. 1 the slider unit 25 can be pivoted horizontally, and this is associated with little expenditure of energy.

In the pan position the fire-resistant closure plates 23, 24 subjected to a high degree of wear and tear, the fire-resistant spout cover and the fire-resistant cover 16 for the container outlet 14 in particular are respectively inspected and if need be replaced. Various other parts such as ceramic rings, breakthrough safety devices, fire-resistant flushing cones etc. are also replaced however. Until now it was normal to carry out the component disassembly, the maintenance operations and the re-assembly or replacement of components manually.

Figure 1:
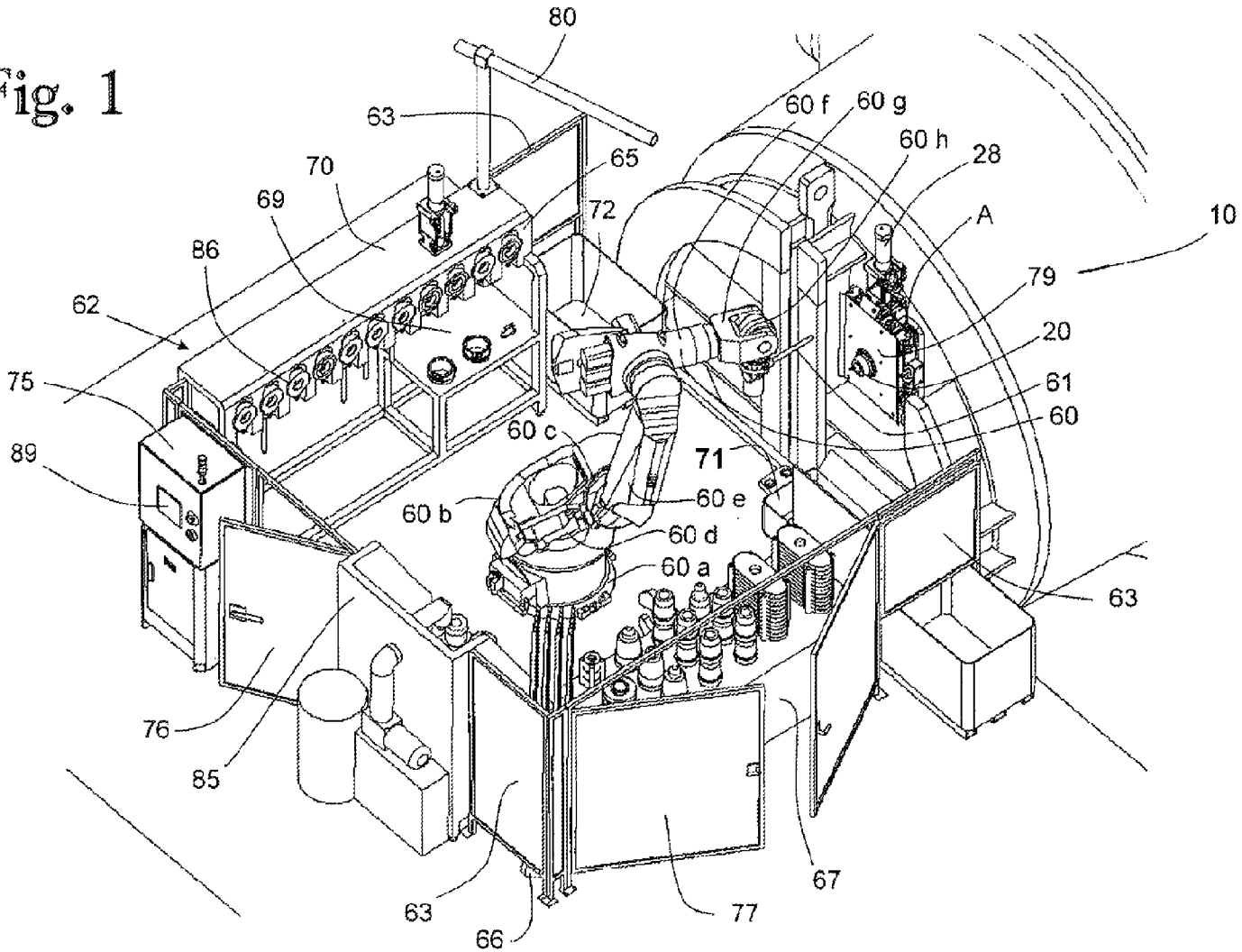
FIG. 1 an arrangement according to the invention for the maintenance of a sliding closure.

According to the invention, according to FIG. 1 an arrangement for the maintenance of the container spout and the sliding closure 20 mounted on the spout of the container 10 is provided for the pan position, an exemplary embodiment of which is indicated in FIG. 2. The arrangement comprises a robot 60 provided with an automatic grip changing system 61 which is disposed in a robot cell 62 defined by protective enclosures 63, surrounded by at least one tool magazine 65, 66, at least one replacement parts magazine 67, various repositories and/or intermediate repositories 69, 70, waste containers 71, 72 etc, connection points for current, compressed air, oxygen, hydraulic oil etc. also being provided. The robot is operationally connected to a control unit 75 which, together with an operator panel 89, is fitted in a separate switch cabinet outside of the robot cell 62.

The robot cell 62 can be entered via a door 76 which can be locked before and during use of the robot. Replacement parts are subsequently supplied via a further door 77.

The robot 60 essentially comprises a base 60*a*, a lateral arm 60*b* on the latter rotatable about a vertical axis with a piston/cylinder unit 60*d* and a pivot bearing 60*c*, a longitudinal arm 60*e* mounted pivotably on the latter, a further additional arm 60*f* which is held rotatably on the end of the longitudinal arm 60*e*, a bracket 60*g* held flexibly on the additional arm 60*f*, and the grip changing system 61 pivotable within the latter. The piston/cylinder unit 60*d* disposed to the side of the lateral arm 60*b* is used to adjust the longitudinal arm 60*e*. Otherwise the robot 60 has further motors and position measuring implements which are not shown in detail.

By means of its construction the robot 60 is able to automatically detect the exact position of the container 10 or of the sliding closure 20, for which purpose a camera can be coupled to the automatic grip changing system 61. If a pan 10 is lying in the pan position, the operator starts the cycle. The robot 60 connects the camera which identifies the pan position and the pan number and by means of which a signal is emitted in order to open the heat shield 79. The camera is then positioned a small distance in front of the slide, and the exact slide position is identified and established. After the position has been identified, the camera is put back in the corresponding tool magazine by the robot 60.

The robot cell 62 is equipped with means for opening and closing the sliding closure 20, for example with the piston/cylinder unit 30 already mentioned, which is placed in a repository 70 in the form of a retainer. The robot 60 can remove the piston/cylinder unit 30 from the repository 70 with a gripper, insert it into the retainer 28, and couple it to the slider unit 25. By means of the robot 60 the connection to a pressure source to the piston/cylinder unit 30 is also provided; corresponding hydraulic hoses are suspended on a gallows 80 above the robot cell 62. By means of the robot 60 the stroke limitation bolt 56 is also engaged with or disengaged from the driving rod 27.

Before the sliding closure 20 is opened, a measuring coil for establishing waste fitted in the region of the container outlet 14 is preferably examined. The robot 60 docks a tool plate with an implement for testing the measuring coil and couples it to a connector on the pan side. The control unit 75 provides the evaluation implement with a start signal, the line and resistance tests are carried out, and the result sent back from the evaluation implement to the control unit is visualised on the operator panel 89. With a negative result the measuring coil must be changed in the workshop.

After a signal for opening the sliding closure has been emitted by the control unit 75 and the pouring channel 14*a* has been opened, cleaning of the pouring channel 14*a* is implemented with the robot 60. As tools oxygen lances are used by means of which the pouring channel 14*a* can be burnt off. The robot 60 drives the lance deeper and deeper into the pouring channel 14*a*. If the robot is driven in fully with the lance, it draws the latter back out of the channel. Before the robot 60 places the respective oxygen lance back in the tool magazine 66 provided for the latter, the length of the lance is tested on a light barrier. If the lance is shorter than the length of the pouring channel, the robot will discard the latter over a waste container and burns off the pouring channel 14*a* again with a new lance.

In order to examine the condition of the fire-resistant components which, if need be, are to be replaced, the robot 60 is brought into a home position and the access door 76 is unlocked, whereupon the operator can enter the robot cell 62 and implement the inspection in a way known in its own right. The state of the pouring channel, of the spout cover 26 and of the slider plate 24 is checked. In order to check the state of the container outlet cover 16, the closure plates 24, 23 must be dismantled or it is changed automatically after a specific number of pass-throughs.

After this check the operator leaves the robot cell 62, locks the access door 76, and enters the scenario to be implemented on the operator panel 89, after which the robot is started by pressing a key. The following scenarios can be selected here:

Scenario 1: no further action

Scenario 2: change of the spout cover 26 (working steps: removal of the old spout cover 26, fitting of a new spout cover 26)

Scenario 3: change of the spout cover 26 and of the closure plates 23, 24 (working steps: removal of the old spout cover 26, removal of the old closure plates 23, 24, fitting of new closure plates 23, 24; fitting of a new spout cover 26)

Scenario 4: change of the spout cover 26, of the closure plates 23, 24 and of the container outlet cover 16 (working steps: removal of the old spout cover 26, removal of the old closure plates 23, 24, pulling out of the container outlet cover 16, insertion of a new container outlet cover 16, fitting of new closure plates 23, 24; fitting of a new spout cover 26)

After each of these scenarios the sliding closure 20 is closed and the piston/cylinder unit 30 disassembled.

In addition to each of these scenarios, by means of the robot 60 a change of a flushing cone known in its own right and not apparent in the drawing, and which is fitted directly next to the outlet 14 in the container 10 and is used for handling the molten metal, can be implemented.

Mortar must be applied to some replacement parts such as the spout cover 26, the securely fixed closure plate 23, the container outlet cover 16, the flushing cone, ceramic rings, breakthrough safety devices or similar before fitting. For this purpose a mortar station 85 is provided on the arrangement according to the invention. The robot 60 passes through beneath a mortar spray device with these replacement parts, the replacement parts provided with mortar then being deposited in an intermediate repository until fitted. For these operations one can also use the time in which there is no pan in the pan position.

The tools available in the tool magazine 65 are advantageously respectively equipped with an adapter 86, and this simplifies gripping of the latter by the robot 60.

When changing the spout cover 26, a carrying ring of the latter is released by turning using an appropriate tool, the spout cover 26 is placed on a spike, tipped out over the waste container 71, and the tool set down with the carrying ring.

When dismantling the closure plates 23, 24, the stroke limitation bolt 56 is removed and set down using an appropriate tool, and the slider unit 25 is released in the way already described above and pivoted out about the axis A (the hinge parts provided can be seen well in FIG. 2). The closure plates 23, 24 are gripped one after the other with a three-jaw gripper in the pouring channel hole, removed and disposed of in one of the waste containers 71, 72.

For the dismantling of the cover 16 in the container outlet 14 the robot 60 connects a hydraulically operated tool, passes with its jaws through the pouring channel 14*a*, forces the latter apart and draws the cover 16 out of the perforated brick 15 and disposes of the cover 16 in the waste container. If necessary, the cover 16 must be removed using a mallet. The perforated brick 15 is cleaned using a wire brush, a mallet or a cutter, and then blown off with compressed air.

Before fitting a new cover 16 in the container outlet 14 a graphite mass is inserted into the perforated brick 15 by means of the robot 60. After this a new cover 16 provided with mortar is fitted. The robot waits for a curing time of approx. 1 min. The mortar is removed from the bearing surface for the securely fixed closure plate 23 using compressed air.

For the fitting of new closure plates 23, 24 the head of the cover 16 is cleaned with a rotating wire brush and then with compressed air if no cover change has previously been implemented. The robot 60 grips a new slider plate 24 from the replacement part magazine 67 and places it in the open slider unit. Then a securely fixed closure plate 23 provided with mortar is inserted.

The pouring channel is cleaned using compressed air. After removing a blocking piece, the sliding closure 20 is closed and the slider unit 25 is brought into the pouring position after which the stroke limitation bolt 56 is fitted.

For the fitting of a new spout cover 26 the robot 60 first of all cleans a corresponding support on the slider plate 24 provided the latter has not previously been changed. The graphite mass is then sprayed onto the support. A new spout cover 26 provided with mortar and the carrying ring are then inserted, and the carrying ring pulled on. The pouring channel 14*a* is cleaned of mortar with compressed air.

After closing the sliding closure 20 and the pouring channel 14*a* and uncoupling and setting down the piston/cylinder unit 30, the heat shield 79 is closed.

Figure 3:
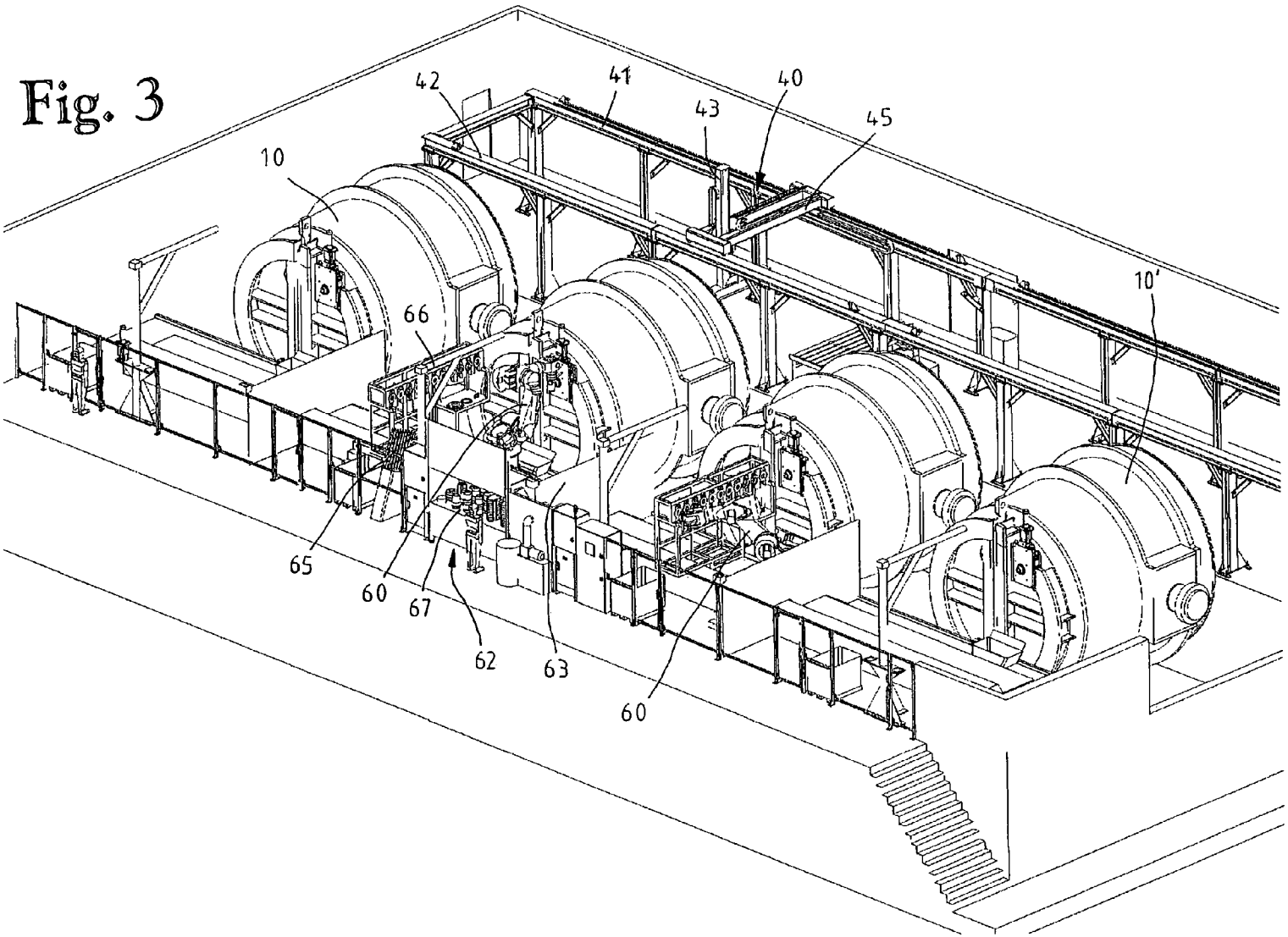
FIG. 3 an arrangement according to the invention with a pan position comprising a number of pans.

According to FIG. 3 an arrangement 50 according to the invention is provided with a pan position which, for example, can accommodate four pans 10 spaced apart equally for maintenance. These pans 10 are generally of the same dimensions. Preferably, for these 4 pans two robots are provided which are of the same design as that of FIG. 1. Therefore, these are not described in full detail. Once again these robots 60, with the magazines 65, 66, 67 assigned to them, are respectively disposed within a robot cell 62 defined by protective enclosures 63.

Furthermore, this arrangement is characterised in that a mobile cover removal device 40 is disposed on the side of the pan 10 lying opposite the robot 60. This cover removal device 40 is held onto a carriage 45 by a rod 43, the carriage 45 being guided adjustably on rails 41, 42 extending next to the pans 10. An arm 46 held on the rod 43 extending into the pan is provided on its head with a corresponding tool (not shown in detail).

With this cover removal device 40 the fire-resistant covers 16 forming the spout of the pans 10 and the fire-resistant perforated bricks 15 (see FIG. 2) can be removed by drilling out or similar. However, it is also conceivable with this type of device to improve the pan coating 12 or to remove one or more flushing cones in the pan base. This device 40 can be moved over the rails 41, 42 from pan to pan, and so only one is required.

This type of arrangement 50 is suitable for continuous casting installations with a number of strands with which more capacity is correspondingly required of the pans. As soon as a pan 10 has been made ready for operation again by the respective robot 60, this pan can be carried away by a crane and the next pan 10', which lies outside, is brought to the location of the robot.

I claim:

1. An arrangement for maintaining a sliding closure mounted on a spout of a container for molten metal and that has a housing part, a housing frame with a slider unit being releaseably braced in the housing part, a refractory slider plate being arranged in the slider unit, a driving rod being arranged in the slider unit, and a stroke limitation bolt that regulates the slider unit and thus opening or closing of a pouring channel of the container, the arrangement comprising:

protective enclosures defining a robot cell;

a robot arranged in said robot cell and having an automatic grip changing system;

at least one tool magazine and at least one replacement part magazine, said robot cell being partly surrounded by said at least one tool magazine and said at least one replacement part magazine;

a repository for storing piston/cylinder units for the sliding closure, each of the piston/cylinder units being removably attachable to the container and when attached to the container, providing linear adjustment of the slider unit by coupling to the driving rod, the stroke limitation bolt being associated with one of the piston/cylinder units, when attached to the container, to enable regulating of the slider unit and thus the opening or closing of the pouring channel of the container;

a control unit operationally connected to said robot and arranged outside of said robot cell; and an operator panel arranged in association with said control unit, wherein said robot is configured to automatically detect a position of the container or of the sliding closure, and bring one of the piston/cylinder units from the repository to said sliding closure and mount that piston/cylinder unit in engagement with the sliding closure and enable connection of the thus-mounted piston/cylinder unit to a pressure source, wherein said robot is further configured to adjust the thus-mounted piston/cylinder unit such that the stroke limitation bolt associated with the thus-mounted piston/cylinder unit is engaged with or disengaged from the driving rod of the slider unit, wherein said robot is further configured to grip a tool from said at least one tool magazine or a replacement part from said at least one replacement part magazine and perform cleaning operations, dismantle components and replace or reinstall the same, and wherein said at least one replacement part magazine includes refractory spout covers each of which is attachable to the slider plate, closure plates of the sliding closure that are each insertable into the housing part, covers for an outlet of the container outlet, flushing cones, breakthrough safety devices and ceramic rings.

2. The arrangement according to claim 1, wherein said at least one replacement part magazine further comprises a fire-resistant spout cover for the sliding closure, fire-resistant closure plates and a fire-resistant cover of an outlet of the container.

3. The arrangement according to claim 1, wherein said at least one replacement part magazine further comprises a flushing cone configured to be fit in the container directly next to an outlet of the container.

4. The arrangement according to claim 1, further comprising a camera coupled to said automatic grip changing system to enable, via imaging, detection of the container and sliding closure position, said camera being stored in said at least one tool magazine.

5. The arrangement according to claim 1, further comprising:

a mobile cover removal device on a side of the container opposite said robot;

rails extending next to the container;

a carriage adjustably guided over said rails; and a rod for holding said cover removal device on said carriage.

6. The arrangement according to claim 1, wherein said robot is further configured to remove the stroke limitation bolt to enable dismantling of each of the closure plates and thus release of the slider unit from the slider housing and pivotal movement of the slider unit relative to the slider housing.

7. The arrangement according to claim 1, wherein said at least one tool magazine includes oxygen lances and the pouring channel is defined partly by the spout cover.

8. The arrangement according to claim 7, wherein said robot is further configured to clean the pouring channel by removing an oxygen lance from said at least one tool magazine and introducing the removed oxygen lance into the pouring channel.

9. The arrangement according to claim 8, wherein said robot is further configured to enable examination of the oxygen lance after use to determine whether to move the oxygen lance back to said at least one tool magazine or to a waste container.

10. The arrangement according to claim 1, further comprising a mortar station for applying mortar to replacement parts.

11. The arrangement according to claim 10, wherein said robot is further configured to convey a replacement part from said at least one replacement part magazine into said mortar station to have mortar applied to said replacement part and then from said mortar station to an intermediate repository.

12. The arrangement according to claim 10, wherein said mortar station is arranged in said robot cell.

13. The arrangement according to claim 1, wherein said robot is further configured to connect an implement for checking a measuring coil configured to be fit in a region of an outlet of the container for establishing waste to a connector on a side of the container, said control unit being configured to deliver a start signal to an evaluation implement of the measuring coil and receiving a result from the measuring coil.

14. The arrangement according to claim 1, further comprising a door that regulates access to said robot cell.

15. The arrangement according to claim 14, wherein said door is lockable.

16. The arrangement according to claim 14, further comprising an additional door that regulates access to said at least one replacement part magazine, said additional door opening to an exterior of said cell.

17. The arrangement according to claim 1, wherein said operator panel is configured to enable entry of a work process for use of said robot.

18. The arrangement according to claim 1, wherein said control unit and said operator panel are fitted in a separate switch cabinet outside of said robot cell.

19. The arrangement according to claim 1, further comprising a door that regulates access to said at least one replacement part magazine, said door opening to an exterior of said cell.

* * * * *